US005152369A

United States Patent [19]

Nakaoka

[11] Patent Number: 5,152,369

[45] Date of Patent: Oct. 6, 1992

[54] APPARATUS AND METHOD FOR HOISTING A PLATFORM ADJACENT A SCAFFOLDING

[76] Inventor: Mori Nakaoka, 20207 - 43rd Avenue, Langley, British Columbia, Canada, V3A 3R9

[21] Appl. No.: 757,134

[22] Filed: Sep. 10, 1991

[51] Int. Cl.[5] ..... E04G 3/10; E04G 21/00

[52] U.S. Cl. ..... 182/129; 182/145; 187/2; 187/6; 187/11

[58] Field of Search ..... 182/129, 142, 145, 146; 187/2, 6, 11

[56] References Cited

U.S. PATENT DOCUMENTS

| | | | |
|---|---|---|---|
| 2,364,547 | 12/1944 | Olsen | 182/145 |
| 2,531,346 | 11/1950 | Schuchert | 187/2 |
| 2,614,994 | 10/1952 | Goodrum | 187/2 |
| 2,718,378 | 9/1955 | Lutton | 182/129 |
| 3,018,842 | 1/1962 | Abrell | 182/129 |
| 3,115,211 | 12/1963 | Ostrander | 187/11 |
| 3,565,217 | 2/1971 | St. Louis | 187/27 |
| 3,610,368 | 10/1971 | Johnson | 182/146 |
| 3,951,236 | 4/1976 | Schreiber | 187/11 |
| 4,938,310 | 7/1990 | Larsen | 182/129 |
| 5,058,708 | 10/1991 | Herrman | 182/129 |

*Primary Examiner*—Reinaldo P. Machado
*Attorney, Agent, or Firm*—Bull, Housser & Tupper

[57] ABSTRACT

A hoist apparatus includes a support member having first and second opposite end portions. A winch including a winch motor and a winch reel rotatable relative to the winch motor about a reel axis is secured to the first end portion of the support member and a flexible tension link is windable on the reel. The apparatus is provided with provisions for releasably connecting the second end portion of the support member to an object such that the first end portion projects from the object, the releasable connecting provisions being dimensioned and positioned on the second end portion to resist forces imposed by the winch on the support member to prevent movement of the support member relative to the object.

21 Claims, 3 Drawing Sheets

APPARATUS AND METHOD FOR HOISTING A PLATFORM ADJACENT A SCAFFOLDING

BACKGROUND OF THE INVENTION

This invention relates to a hoist for hoisting a platform adjacent a building scaffolding to a location above the ground.

In performing construction work on a building, it is often required to work at locations above the ground adjacent a building. Typically, to work in such locations, construction personnel erect building scaffolding to permit them to stand on a platform supported above the ground by the scaffolding. Such platforms are usually accessed with the use of a ladder.

If the job requires that heavy articles such as bricks or concrete block are needed on the platform, a construction worker must carry such bricks or block up the ladder or must employ a forklift truck or crane to lift the heavy articles. Carrying the articles up the ladder by hand is impractical and the use of a forklift truck or crane adds to the complexity and cost of completing the work on the building. What is needed therefore is a builder's lift device which is economical to manufacture, easy to carry over rough ground, quick to install and dismantle, and which eliminates the need to carry objects up the ladder, and which eliminates the use of a forklift truck and crane.

Prior inventors have sought to address this need by providing hoisting apparatuses. For example, U.S. Pat. No. 2,531,346 to Schuchert and U.S. Pat. No. 3,614,994 to Goodrum both disclose a builder's hoist which includes a pair of spaced apart track members secured to a building. A raiseable platform having wheels which cooperate with the track members is raised and lowered by a winch mechanism located at a bottom portion of the track members. As another example, U.S. Pat. No. 3,565,271 to St. Louis discloses an elevator mechanism which includes a raiseable platform suspended by cables wound on reels located on a platform fixed at an upper location, the cables extending downward and being threaded around pulleys located at a lower location near the ground. The cables extend through openings in the platform which serve to guide the raiseable platform as it is raised and lowered.

While each of the above inventors has made a good attempt to satisfy the above need, none has disclosed devices which are particularly easy to install and collapse and yet permit reasonable loads to be lifted.

SUMMARY OF THE INVENTION

In accordance with the present invention there is provided a hoist apparatus comprising a support member having first and second opposite end portions. A winch including a winch motor and a winch reel rotatable relative to the winch motor about a reel axis is secured to the first end portion of the support member and a flexible tension link is windable on the reel. The apparatus is provided with releasable connecting means for releasably connecting said second end portion of the support member to an object such that the first end portion projects from the object, the releasable connecting means being dimensioned and positioned on the second end portion to resist forces imposed by the winch on the support member to prevent movement of the support member relative to the object.

In accordance with another aspect of the invention there is provided an apparatus and method for hoisting objects, the apparatus including a building scaffolding having horizontally spaced apart scaffolding members, and upper and lower portions. The apparatus includes first and second hoist apparatuses, each apparatus having a rotatable winch reel and a cable wound on the winch reel. Each hoist apparatus has releasable connecting devices to permit the first and second hoist apparatuses to be connected to respective horizontally spaced apart scaffolding members at the lower portion thereof. First and second pulleys are secured to the scaffolding above the lower portion, the first and second cables extending upwards from the first and second winch reels respectively towards the pulleys, around the pulleys, and downwards towards the first and second hoist apparatuses. A platform having opposite end portions is secured to the free end portions of the first and second cables respectively. Rotating means are used to rotate the first and second winch reels relative to the first and second apparatuses respectively, to wind the first and second cables respectively on the first and second winch reels respectively, to hoist the platform upwards, towards the pulleys.

In accordance with another aspect of the invention the apparatus preferably includes regulating means for regulating the rate of winding the first and second cables on the winch reels to ensure the platform is maintained generally level.

Preferably, the regulating means includes a roller having an axis parallel to the axis of the winch reel and biasing means for biasing the roller against the winch reel to force the cable to accumulate axially along the reel.

In accordance with another aspect of the invention the first and second apparatuses further include means for preventing rotation of the winch reels when the platform reaches a pre-defined distance from the pulleys.

Preferably the rotating means includes first and second electric motors for rotating the first and second winch reels respectively and a switch for disconnecting power to the first and second motors. The switch is actuated when the platform reaches the pre-defined distance, the switch being located near the lower portion of the scaffolding and having an off position wherein movement of the reels is prevented and having an on position wherein movement of the reels is permitted. The apparatus further includes an actuating member secured to at least one of the flexible tension links, a cooperating member secured to the scaffolding near the pulleys, the distance between the cooperating member and the pulleys defining the pre-defined distance. The cooperating member is moveable by the actuating member when the actuating member is near the predefined distance. A flexible tension link extends between the switch and the cooperating member such that movement of the cooperating member actuates the switch into the off position, and extending means are provided for permitting sufficient resilient extension of the flexible tension link in the direction of tension is used to permit the switch to be manually actuated into the on position while the actuating member is in contact with the cooperating member.

In accordance with another aspect of the invention there is provided a method of hoisting objects, the method comprising the steps of:

a) releasably connecting first and second hoist apparatuses to horizontally spaced apart scaffolding members of a building scaffolding;

b) connecting first and second pulleys to the scaffolding at points above the spaced apart scaffolding members;

c) extending respective free ends of first and second cables respectively from first and second winch reels respectively upwards towards the pulleys, around the pulleys, and downwards towards the first and second hoist apparatuses;

d) connecting the free end portions of the first and second cables to opposite end portions of a platform; and e) rotating the first and second winch reels relative to the first and second apparatuses respectively, to wind the first and second cables respectively on the first and second winch reels respectively, to move the platform upwards, towards the pulleys.

The invention described herein provides a portable, lightweight, inexpensive hoisting apparatus which is fast and easy to install on virtually any scaffolding.

BRIEF DESCRIPTION OF THE DRAWINGS

In drawings which illustrate the invention.

DETAILED DESCRIPTION

Figure 1:
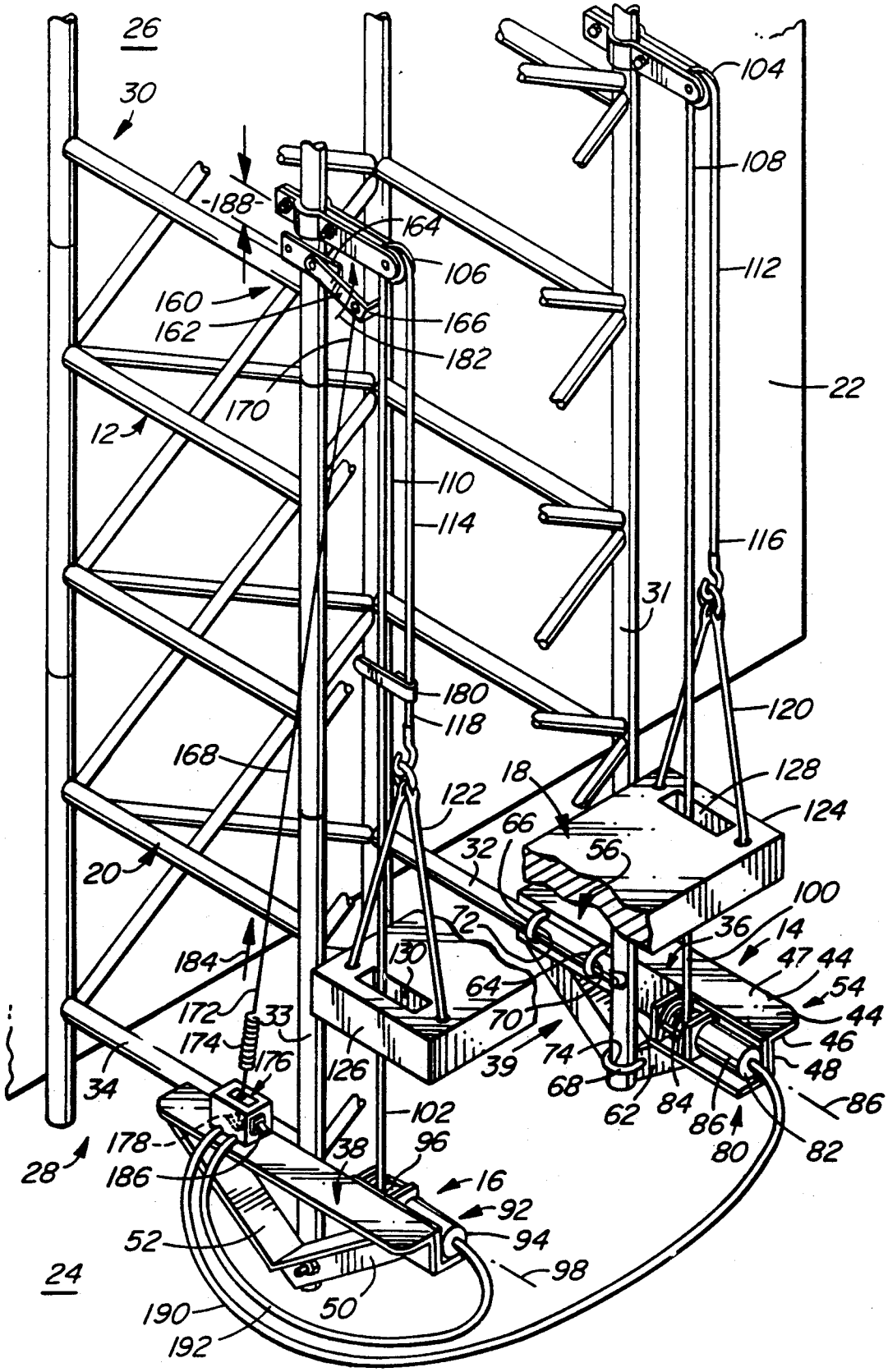
FIG. 1 is a perspective view of an apparatus according to a first embodiment of the invention.

Referring to FIG. 1, an apparatus for hoisting objects is shown generally at 10. The apparatus includes a building scaffolding 12, first and second hoisting apparatuses 14 and 16 according to the invention and a platform 18.

The building scaffolding is conventional and has a plurality of structural members generally depicted by member 20. The structural members are connected together to form geometrical structures which form a rigid structure extending adjacent a building 22. The rigid structure extends from the ground 24 to an upper portion 26 of the building on which work is being performed. The scaffolding thus has a lower portion 28 adjacent the ground 24 and has an upper portion 30 adjacent the portion of the building being worked.

Commonly, and as shown in FIG. 1, there are first and second horizontally spaced apart horizontal scaffolding members 32 and 34 and first and second horizontally spaced apart vertical scaffolding members 31 and 33 at the lower portion 28.

To the first and second scaffolding members 32 and 34 are secured the first and second hoist apparatuses 14 and 16. The first and second hoist apparatuses are generally similar and therefore reference will be made to the apparatuses in general, it being understood that numerical references designating components of one hoist apparatus also refer to similar structure of the other apparatus.

Figure 2:
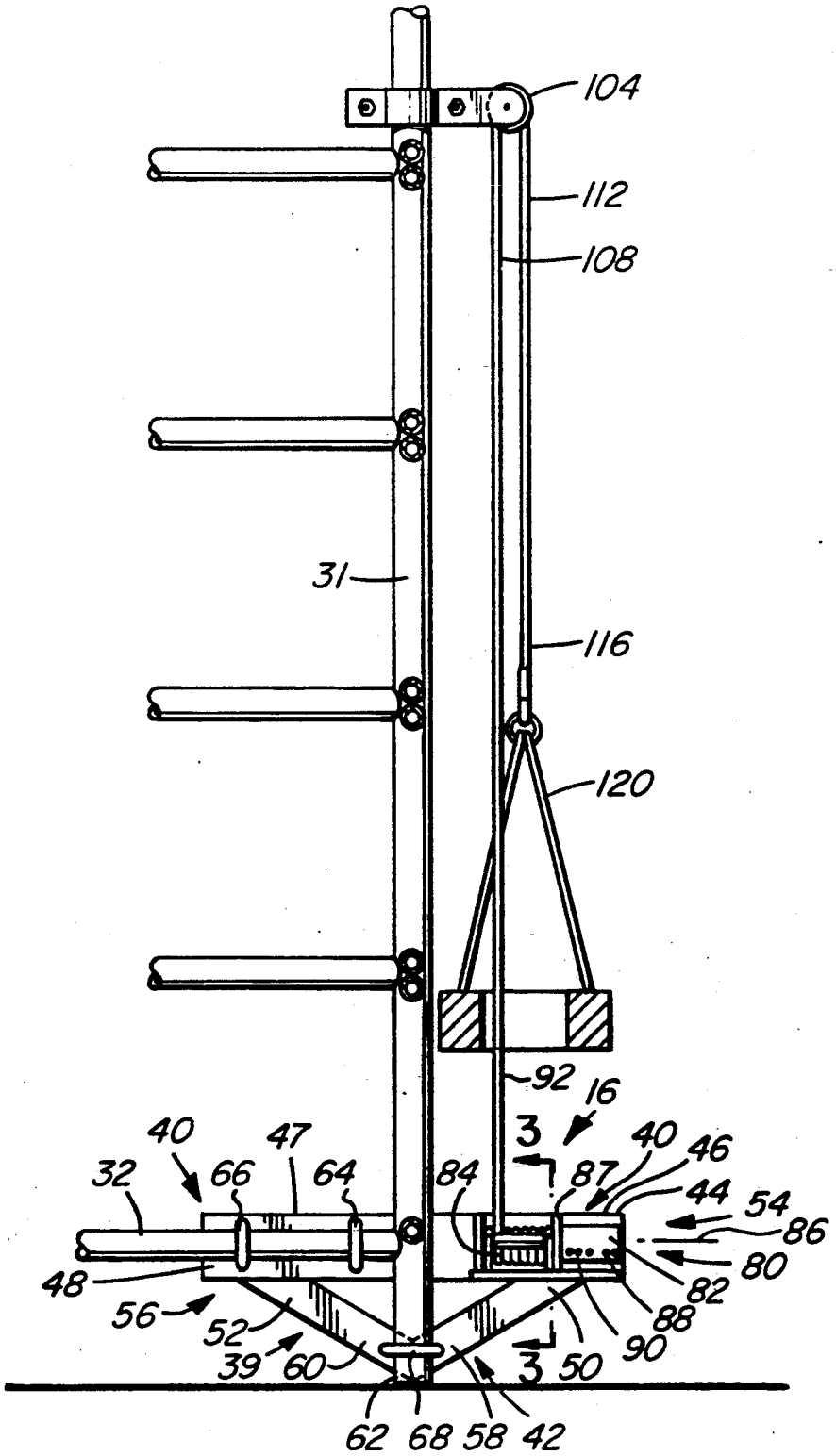
FIG. 2 is a side view of a first hoist apparatus according to the first embodiment of the invention.

Referring to FIG. 2, each hoist apparatus includes a generally triangular frame 39. The triangular frame has a top portion 40 and a bottom portion 42. The top portion includes a support member 44 formed of an angle-sectioned member iron having a generally straight horizontal flange 46 having a flat support surface 47 and a generally vertical web 48 extending from the flange. The bottom portion 42 includes first and second lower angle-sectioned members 50 and 52 connected to first and second opposite end portions 54 and 56 of the support member 44, and having respective distal end portions 58 and 60 connected together to form a lower vertex 62 of the triangular frame.

Referring back to FIG. 1, each hoist apparatus has first, second and third U-clamps 64, 66 and 68 for releasably connecting the frame to respective horizontally spaced apart scaffolding members. The first U-clamp 64 is located at an approximate mid-position of the support member 44 and provides a first opening 70 for receiving and holding the horizontal scaffolding member 32 therein. Conventionally, nuts (not shown) on the U-clamp are tightened to render the opening smaller to clamp the support member to the scaffolding member.

The second U-clamp 66 is located on the second end portion 56 of the support member 44 and provides a second opening 72 in alignment with the first opening 70 for receiving and holding the horizontal scaffolding member 32 therein. As with the first U-clamp, nuts on the U-clamp are tightened to render the opening smaller to clamp the support member to the scaffolding member. The first and second U-clamps are spaced apart sufficiently to resist forces imposed on the frame 39 to prevent movement of the frame relative to the scaffolding.

The third U-clamp 68 is located at the lower vertex 62 at the lower portion 42 of the frame and provides a third opening 74 for receiving and holding the vertical scaffolding member 31 therein. As with the first U-clamp, nuts on the U-clamp are tightened to render the opening smaller to clamp the lower vertex 62 to the scaffolding member. The third U-clamp is spaced apart sufficiently from the first and second U-clamps to further resist forces imposed on the frame 39 to prevent movement of the frame relative to the scaffolding.

The first, second and third U-clamps 64, 66 and 68 thus act as first, second and third releasable connecting means for releasably connecting the frame to an object. The first, second and third U-clamps are well spaced apart and thus are dimensioned and positioned on the second end portion of the support member to resist forces imposed on the frame.

Referring back to FIG. 2, each hoist apparatus further includes a winch shown generally at 80, the winch including a winch motor 82 and a winch reel 84 rotatable relative to the winch motor about a reel axis 86, the winch motor acting as rotating means for rotating the winch reel. The winch motor is secured to the first end portion 54 of the support member 44 by conventional bolts (not shown) such that an uppermost portion 87 of the reel is below the flat support surface 47. In the preferred embodiment, the winch is a conventional 2-ton electric winch having on/off and forward/reverse switch contacts 88 and 90 respectively. By applying electric current to selected contacts, the reel can be controlled as will be explained further below.

The apparatus includes two winches with associated winch bodies, winch reels and winch axes. In FIG. 1, a first winch, winch motor, winch reel and winch axis are designated by numerical references 80, 82, 84 and 86 and a second winch, winch motor, winch reel and winch axis are designated by numerical references 92, 94, 96 and 98.

Wrapped upon the reels 84 and 96 are first and second flexible tension links 100 and 102 respectively which, in the preferred embodiment, are conventional wire rope cables. Rotation of the reels 84 and 96 in a forward direction wraps the cables on their respective reels and rotation of the reels 84 and 96 in an opposite or reverse direction unwraps the respective cables from the reels.

The winch reels 84 and 96 are conventionally mounted on respective reel shafts (not shown), the reel shafts being connected to respective output shafts (not shown) of respective electric motors by conventional gearing arrangements (not shown) which prevent the reels from rotating when power to the electric motors is cut off.

Still referring to FIG. 1, the apparatus further includes first and second pulleys 104 and 106 respectively, Which are secured to the scaffolding in horizontally spaced apart relation above the lower scaffolding portion 28, preferably directly above corresponding winch reels. Mid-portions 108 and 110 of the first and second cables 100 and 102 extend upwards from respective reels and are wrapped around the first and second pulleys 104 and 106 respectively. The cables further have outer portions 112 and 114 respectively which extend downwards from the pulleys, towards the first and second hoist apparatuses respectively and which terminate in free ends 116 and 118 connected to first and second bridles shown generally at 120 and 122 respectively. The first and second bridles are connected to first and second opposite end portions 124 and 126 of the platform 18 and therefore the platform can be raised or lowered by rotating the first and second reels in the forward or reverse directions respectively.

In the preferred embodiment, the first and second opposite end portions 124 and 126 have first and second openings 128 and 130 respectively, through which the first and second mid portions 108 and 110 respectively are passed. The first and second openings act to guide the platform as it is raised and lowered to prevent the platform from swinging in directions transverse and longitudinal to the platform.

Regulating Means

Figure 3:
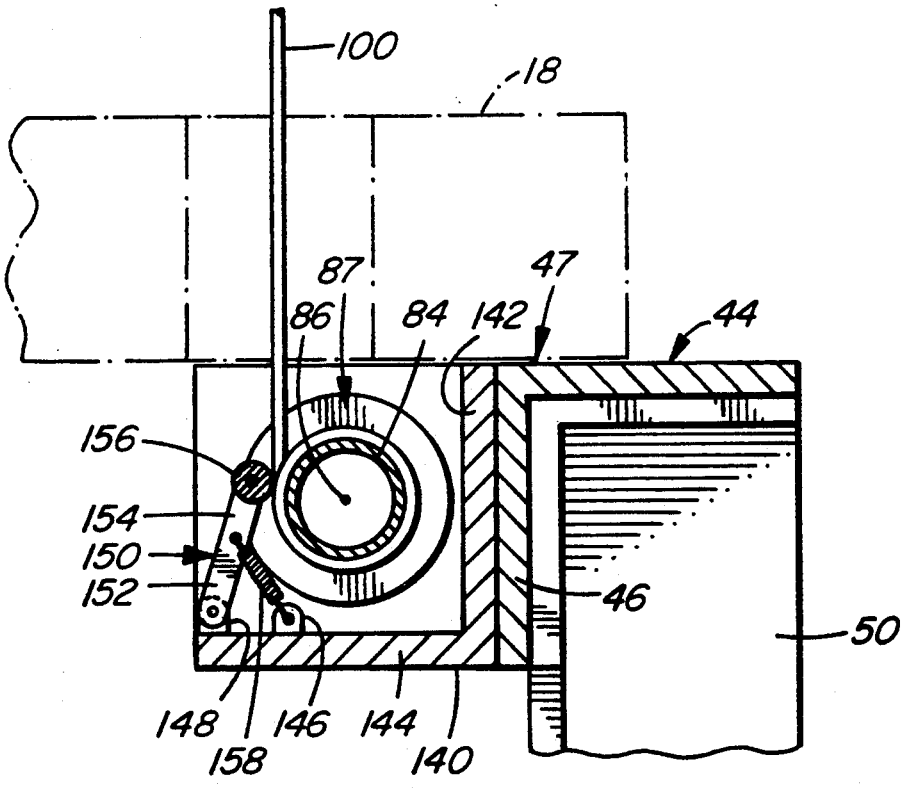
FIG. 3 is a cross-sectional view of regulating means according to the first embodiment of the invention.

Referring to FIG. 3, it will be appreciated that the winding of the cables upon the reels should be evenly distributed on the reels such that the rate of take up or let out of each cable is the same. Preferably, excessively unequal or irregular accumulation of turns of the cable at any specific location on an associated reel is prevented. This is accomplished by mounting a regulating means to cooperate with the winches on respective L-shaped winch platforms, one of which is shown generally at 140.

The winch platform has a vertical portion 142 and a horizontal portion 144. The vertical portion is secured to the vertical web 46 of the support member 44. The winch is secured to the horizontal portion 144. Also connected to the horizontal portion are a spring anchor 146 and a lever mounting anchor 148. To the lever mounting anchor 148 is connected a lever 150 having a proximal end portion 152 and a distal end portion 154. The proximal end portion 152 is pivotally connected to the lever mounting anchor 148 and thus the lever is free to pivot about the lever mounting anchor 148. To the distal end portion 154 of the lever, a rubber roller 156 is rotatably connected to rotate about a roller axis 157 which is parallel to the axis of rotation 86 of the winch. The length of the lever 150 and the position of the lever mounting anchor 148 are chosen such that the rubber roller 156 is operable to contact the first cable 100 adjacent the first winch reel 84. A spring 158 is connected between the distal end portion 154 of the lever and the spring anchor 146, the spring acting to bias the roller towards the reel to pinch the cable between the the cable to accumulate evenly and longitudinally on the reel. The roller 156 biased against the cable acts as a regulating means for regulating the winding of the cable to distribute the cable 100 on the reel 84 radially evenly in a manner which prevents excessive accumulation of the cable 100 at any specific location on the reel 84. Both the first and second winches have the regulating means as described above which acts to regulate the winding of the cables 100 and 102 of FIG. 1 such that both cables are wound upon the reels at the same rate and therefore the platform is maintained generally level.

Shut-off Mechanism

Still referring to FIG. 1, the apparatus further includes a shut-off mechanism shown generally at 160 for preventing rotation of the winch reels when the platform reaches a predetermined distance from the pulleys 104 and 106. The shut-off mechanism includes a co-operating member 162 which is pivotally connected to a clamp 164 secured to the scaffolding member 30. The co-operating member has a right angled portion 166 which extends immediately adjacent the mid-portion 110 of the cable 102 but Which is mounted so as not to be obstructed in rotational movement by the mid-portion 110 of the cable 102. An actuating link, Which in this embodiment includes a wire 168 has a first end portion 170 connected to the co-operating member 162 and has a second end portion 172 connected to a spring 174. The spring is further connected to an on/off switch shown generally at 176, the on/off switch being located adjacent the lower portion 28 of the scaffolding within easy access of an operator of the apparatus. The on/off switch has an on/off actuator 178 placing the switch in an on-position When the on/off actuator is downwardly disposed and placing the switch in an off-position when the on/off actuator 178 is in an upward position. It will be appreciated that power is supplied to the electric winches when the on/off switch is in the on-position and power is cut off when the switch is in the off-position.

The shut-off mechanism further includes an actuating member 180 which is secured to the free end 118 of the cable 102. The actuating member is mounted to the free end portion to project inwards, toward the building 22 such that when the actuating member 180 comes in contact with the horizontal portion 166 the actuating member cooperates with the horizontal portion 166 and moves the co-operating member 162 in a direction indicated by arrow 182. Rotation of the co-operating member in direction 182 causes the wire 168 to move in a direction indicated by arrow 184 whereupon the actuating lever 178 of the switch 176 is raised to the upward position thereby placing the switch in the off position. The apparatus further includes a forward/reverse switch which is operable to control the rotational direction of the winch reels 84 and 96. The forward/reverse switch being designated 186.

The shut-off mechanism 160 disconnects power to the electric winches when the platform is at a predetermined distance from the pulleys 104 and 106. The predetermined distance is determined by a clamp distance 188 between the pulley 106 and the clamp 164. The spring 174 permits the switch actuating lever 178 to be returned to the on-position even while the co-operating member 162 is rotated by the actuating member 180.

This permits an operator to actuate the switch 186 to change the direction of rotation of the reels 84 and 96 after the platform has been stopped at the predetermined distance 188.

OPERATION

Referring to FIG. 1, the building scaffolding 12 is conventionally already situated adjacent the building 22. To install the hoist apparatus, the first and second hoisting apparatuses are connected to the spaced apart horizontal scaffolding members 32 and 34 and to the spaced apart vertical scaffolding members 31 and 33 using the first, second and third U-clamps 64, 66 and 68. The first and second hoisting apparatuses are connected such that the first end portions 54 project outwards in the same direction away from the scaffolding such that the support surface 47 be within a common horizontal plane. The first and second pulleys 104 and 106 are then connected to the upper portion 26 of the scaffolding at points above the spaced apart scaffolding members 32 and 34.

Conventional wires 190 and 192 are then used to connect the on/off and forward/reverse switch contacts of respective winches to the on/off switch 176 and forward/reverse switch 186 respectively.

The platform 18 is then placed upon the flat support surfaces 47 of each of the projecting end portions 54 and should be level in both vertical planes. The forward-/reverse switch 186 is then placed in the reverse position, and the on/off 176 switch is placed in the on-position whereupon the winches are actuated in the reverse direction and the cables 100 and are unwound from respective winch reels 84 and 96.

As the cables 100 and 102 are unwound, they are threaded by an operator through respective first and second openings 128 and 130 in the platform 18. An operator holding the free ends 116 and 118 of the cables then climbs the scaffolding to extend respective cables over the first and second pulleys 104 and 106 respectively. The operator then climbs down the scaffolding while holding the end portions 116 and 118. The end portions are then connected to the first and second bridles 120 and 122 respectively and the free ends are thus now connected to the opposite end portions of the platform.

The operator then secures the clamp 164 at the clamp distance 188 from the second pulley 106 and connects the first end portion 170 of the wire 168 to the co-operating member 162. The second end portion of 172 is then connected to the spring 174 which is in turn connected to the actuating member 178 of the on/off switch 176.

Finally, the actuating member 180 is fastened to the free-end 118 of the second cable and the apparatus is rendered ready for operation.

In use, an operator may place bricks or other loads upon the platform 18. The operator then places the forward/reverse switch 186 in the forward direction to ensure the winch reels will wind the cables 100 and 102 thereon and then the operator actuates the on/off switch 176 into the on-position whereupon power is supplied to the winches 80 and 92 and the first and second winch reels 84 and 96 are rotated to wind the cables 100 and 102 upon winch reels 84 and 96 respectively to move the platform upwards, towards the pulleys.

As the cables 100 and 102 are wound, referring to FIG. 3, the rubber roller 156 biases the cable towards the respective reel causing radially stacked portions of cable on the reel to be pressed radially inwardly tending to distribute the cable evenly upon the reel. As both winch reels 84 and 96 are fitted with similar rubber rollers 156 and associated biasing means, the winch reels accumulate cables 100 and 102 at the same rate and thus effective diameters of the reels are maintained generally equal. It can be seen that the rate of accumulation is regulated by the biasing means of the regulating means such that the platform is maintained generally level.

Referring back to FIG. 1, as the platform nears the predetermined distance from the pulleys, the actuating member 180 contacts the co-operating member 162 thereby rotating the co-operating member in the direction indicated by arrow 182. This pulls upwards on the wire 168 which stretches the spring 174 creating a force upon the actuating member 178, the force being sufficient to actuate the on/off switch 176 into the off-position. When the on/off switch is placed in the off-position, power to the first and second winches 80 and 92 is interrupted Simultaneously and rotation of the winch reels 84 and 96 is prevented. The gearing mechanism of the winches prevents the reels from rotating while power to the winch is disconnected. The platform is thus raised and maintained at the required height and should be essentially level due on the reels.

To lower the platform, the operator actuates the forward/reverse switch 186 to permit power to be supplied to the reverse contacts of the winches 80 and 92 respectively. The operator then actuates the actuating member 178 against the force of spring 174, thereby extending the spring and power is supplied to the winches permitting the cables 100 and 102 to be unwound from the reels 84 and 96 respectively. The spring thus acts as extending means for permitting sufficient resilient extension of the actuating link in a direction of tension to permit the on/off switch to be manually actuated into the on-position while the actuating member is in contact with the co-operating member.

The platform is thus lowered and the actuating member 180 moves away from the second pulley 106 thereby permitting the co-operating member 162 to rotate in a direction opposite to arrow 182, thus relieving the force supplied by the spring 174 and permitting the actuating member 178 to remain in the on position without operator intervention.

The platform will be lowered by the unwinding reels 84 and 96 until the platform again rests upon the flat surface 47 of the projecting end portions of respective hoist apparatuses. The operator then actuates the actuating member 178 of the on/off switch 176 into the off-position whereupon power to the winches 80 and 92 is interrupted and the winches stopped. The platform is thus returned to its starting position at rest on the flat surfaces 47 of the projecting end portions.

While a specific embodiment of the invention has been described and illustrated, such embodiment is not considered as limiting the invention as construed in accordance with the accompanying claims.

I claim:

1. A hoist apparatus comprising:

a) a support member having first and second opposite end portions;

b) a winch including a winch motor and a winch reel rotatable relative to said winch motor about a reel axis, said winch motor being secured to said first end portion of said support member;

c) a flexible tension link windable on said reel when said reel is rotated;

d) releasable connecting means for releasably connecting said second end portion of said support member to an object such that said first end portion projects from said object, the releasable connecting means being dimensioned and positioned on said second end portion to resist forces imposed by said winch on said support member to prevent movement of said support member relative to said object.

2. An apparatus as claimed in claim 1 wherein said releasable connecting means includes first and second securing means disposed in spaced apart relation on said second end portion.

3. An apparatus as claimed in claim 2 wherein the first and second securing means include first and second openings respectively, the first and second openings being disposed in alignment with each other.

4. An apparatus as claimed in claim 3 wherein the first and second securing means include first and second U-clamps respectively.

5. An apparatus as claimed in claim 1 wherein the support member has a generally straight horizontal flange having a flat support surface and a generally vertical web extending from the flange.

6. An apparatus as claimed in claim 1 further including first and second lower members connected to said first and second opposite end portions of the support member respectively, said first and second lower members having respective distal end portions connected together to form a generally triangular frame having an upper portion formed by said support member, a lower portion formed by the first and second lower members and a lower vertex at the distal end portions of the first and second lower members.

7. An apparatus as claimed in claim 6 wherein the releasable connecting means includes first, second and third securing means disposed in spaced apart relation on said triangular frame.

8. An apparatus as claimed in claim 7 wherein said first and second securing means are disposed on said second end portion of said support member and said third securing means is disposed at said lower vertex of said triangular frame.

9. An apparatus as claimed in claim 1 further including regulating means for regulating the winding of said flexible tension link on said reel when said winch is operated to distribute the flexible tension link radially evenly on said reel to prevent excessive accumulation of said flexible tension link at any specific location on said reel.

10. An apparatus as claimed in claim 9 wherein said regulating means includes:

a) a roller adjacent said reel, the roller being journalled for rotation about an axis generally parallel to the reel axis, the flexible tension link being disposed between said reel and said roller; and b) biasing means for biasing said roller towards said reel to pinch said flexible tension link therebetween.

11. A device for hoisting objects, the device comprising:

a) a building scaffolding having a lower scaffolding portion including vertically and horizontally spaced apart scaffolding members and an upper scaffolding portion;

b) a support member having first and second opposite end portions;

c) a winch including a winch motor and a winch reel rotatable relative to said winch motor about a reel axis, said winch motor being secured to said first end portion of said support member;

d) a flexible tension link windable on said reel when said reel is rotated;

e) releasable connecting means for releasably connecting said second end portion of said support member to said horizontally spaced apart scaffolding members such that said first end portion projects from said scaffolding; the releasable connecting means being dimensioned and positioned on said second end portion to resist forces imposed by said winch on said support member to prevent movement of said support member relative to said horizontally spaced apart scaffolding members;

f) first and second pulleys secured to said scaffolding in horizontally spaced apart relation above said lower scaffolding portion, the first and second cables extending upwards from said first and second winch reels respectively towards said respective first and second pulleys, extending about said pulleys, and extending downwards towards said first and second hoist apparatuses;

g) a platform having opposite end portions, the free end portions of said first and second cables being secured to said opposite end portions of the platform such that rotation of said first and second winch reels takes in said first and second cables respectively on said first and second winch reels so as to move said platform upwards towards said pulleys.

12. A device as claimed in claim 11 further including regulating means for regulating the rate of winding of the first and second cables on said winch reels to ensure the platform is maintained generally level.

13. A device as claimed in claim 12 wherein the regulating means of each hoist apparatus comprises:

a) a roller having an axis parallel to an axis of rotation the operative winch reel; and b) biasing means for biasing the roller against the winch reel to force the cable to accumulate longitudinally on the reel.

14. A device as claimed in claim 11 further including means for preventing rotation of said winch reels when said platform reaches a predetermined distance from said pulleys.

15. A device as claimed in claim 14 wherein:

a) the means for preventing rotation includes a switch for disconnecting power to said first and second motors, said switch being actuated when said platform reaches said predetermined distance.

16. A device as claimed in claim 15 wherein:

a) the switch is located near said lower scaffolding portion and the switch has an off-position wherein movement of the reels is prevented, and has an on-position wherein power is supplied to rotate the reels; and b) wherein said means for preventing rotation includes:

1) an actuating member secured to at least one of said flexible tension links;

2) a cooperating member secured to said scaffolding near said predetermined distance and moveable by the actuating member when said actuating member is near said predetermined distance;

3) an actuating link extending between said switch and said cooperating member such that movement of said cooperating member actuates said switch into said off-position; and 4) extending means for permitting sufficient resilient extension of said actuating link in a direction of tension to permit said switch to be manually actuated into said on-position while said actuating member is in contact with said cooperating member.

17. A method of hoisting objects, the method comprising the steps of:

a) releasably connecting first and second hoist apparatuses to horizontally spaced apart scaffolding members of a building scaffolding;

b) connecting first and second pulleys to said scaffolding at points above said spaced apart scaffolding members;

c) extending respective free ends of first and second cables wound on first and second winch reels mounted on said hoist apparatuses, said pulleys, and downwards towards said first and second hoist apparatuses;

d) connecting said free ends of said first and second cables to opposite end portions of a platform;

e) rotating said first and second winch reels relative to said first and second apparatuses respectively, to wind said first and second cables respectively on said first and second winch reels respectively, to move said platform upwards, towards said pulleys.

18. A method as claimed in claim 17 further including the step of winding the first and second cables on said winch reels at the same rate to maintain the platform generally level.

19. A method as claimed in claim 18 wherein the step of winding includes the step of biasing the cables towards respective reels to prevent excessive accumulation of cable at any specific location thereby maintaining the platform generally level.

20. A method as claimed in claim 17 wherein the step of rotating the winch reels includes preventing rotation of said winch reels when said platform reaches a predetermined distance from said pulleys.

21. A method as claimed in claim 20 wherein the step of preventing rotation includes the step of disabling electric motors driving respective winch reels.

* * * * *